United States Patent [19]

Mori

[11] 3,975,815

[45] Aug. 24, 1976

[54] METHOD OF INSERTING TENSION WIRES IN THE PROCESS OF WIRE ASSEMBLING

[75] Inventor: Takemitsu Mori, Hachioji, Japan

[73] Assignee: Nippon Concrete Industries Co. Ltd., Tokyo, Japan

[22] Filed: Dec. 30, 1974

[21] Appl. No.: 537,365

[52] U.S. Cl. ..... 29/433; 29/241; 29/452; 52/230; 254/1; 254/29 A; 254/105

[51] Int. Cl.[2] ..... B23P 19/04

[58] Field of Search..... 29/433, 241, 452, 155 C; 254/29 A, 1, 105, 134.3 R, 134.3 FT; 52/230; 140/92.1, 3 C

[56] References Cited

UNITED STATES PATENTS

| | | | |
|---|---|---|---|
| 1,569,054 | 1/1926 | Warner | 254/134.3 FT |
| 2,532,504 | 12/1950 | Lapsley | 254/134.3 R |
| 2,988,794 | 6/1961 | Gutt | 254/29 A X |
| 3,675,898 | 7/1972 | Fattor | 254/134.3 FT |
| 3,719,982 | 3/1973 | Tindal | 29/452 |
| 3,785,617 | 1/1974 | Friedrich | 254/1 |

FOREIGN PATENTS OR APPLICATIONS

| | | | |
|---|---|---|---|
| 940,799 | 11/1963 | United Kingdom | 52/230 |

*Primary Examiner*—Charlie T. Moon
*Attorney, Agent, or Firm*—Oblon, Fisher, Spivak, McClelland & Maier

[57] ABSTRACT

This invention relates to a method of inserting tension wires in the process of wire assembling for a concrete pole or pile characterized in that forward ends of a required number of tension wires are clamped together by a chuck, and the chuck is inserted from one end of a wire cage to the other end and interiorly thereof, so that a number of tension wires can be inserted into the wire cage at one time.

4 Claims, 27 Drawing Figures

FIG. 1
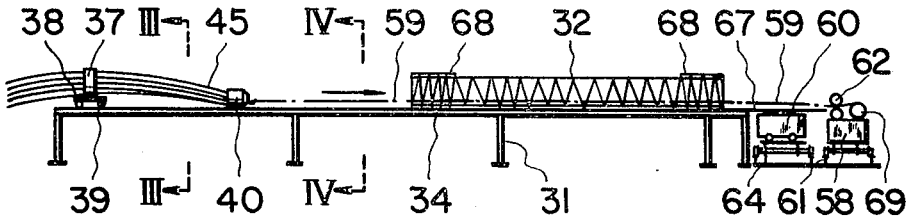
FIG. 2
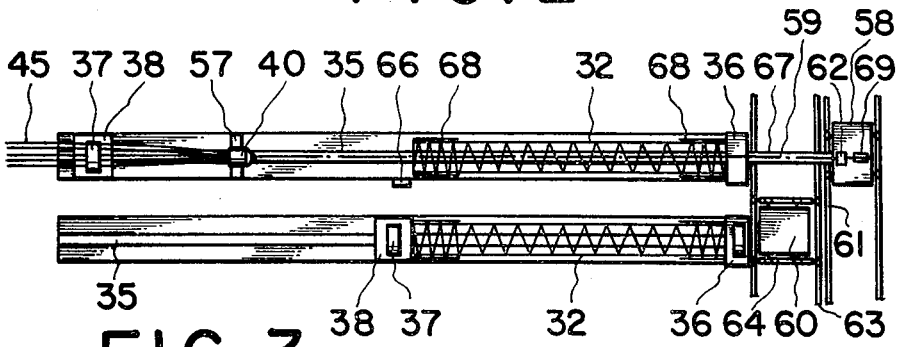
FIG. 3
FIG. 4
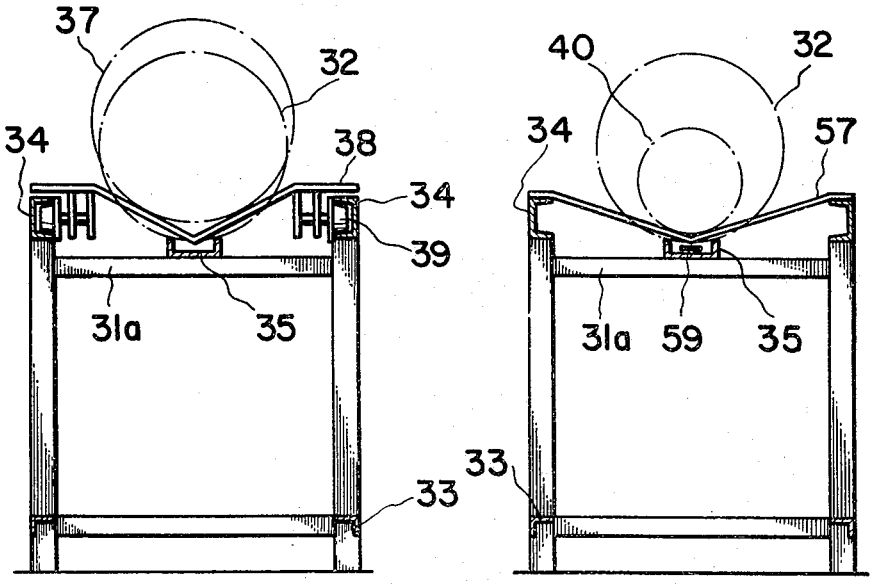

METHOD OF INSERTING TENSION WIRES IN THE PROCESS OF WIRE ASSEMBLING

SUMMARY OF THE INVENTION

This invention relates to a method of inserting tension wires in the process of wire assembling for a concrete pole or pile.

Hitherto the operation of inserting tension wires into a wire cage for a concrete pole or pile has been done by manually inserting a number of tension wires one at a time through a long wire cage. Therefore many persons and a long time have been required for that operation, so that it is very inefficient. That also causes a problem that the product cost is increased.

The first object of the present invention is to provide a method of inserting a number of tension wires through a wire cage at a time in order to eliminate the above defects.

The second object of the present invention is to provide a method of accomplishing the operation in a short period of time by a mechanical operation and not by a manual operation.

The third object of the present invention is to make the above mechanical operation suitable for mass production so as to decrease the product cost.

The other objects and the features of present invention will be apparent from some examples embodying the present invention described later.

BRIEF DESCRIPTION OF THE DRAWINGS

FIG. 1 is a partial side elevation view showing how tension wires are inserted into a wire cage in the first embodiment of the present invention;

FIG. 2 is a plan view corresponding to FIG. 1;

FIG. 3 is an enlarged sectional view taken along the line III—III of FIG. 1;

FIG. 4 is an enlarged sectional view taken along the line IV—IV of FIG. 1;

DETAILED DESCRIPTION OF THE INVENTION

Figure 5:
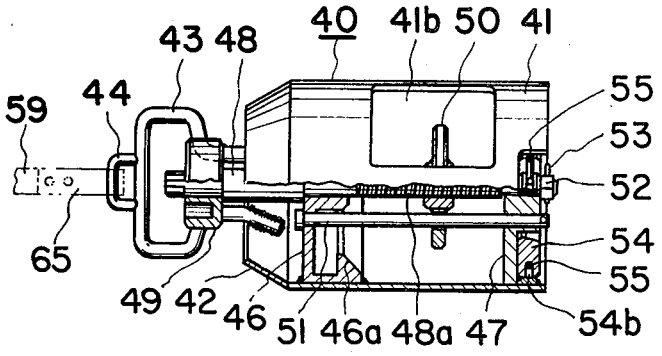
FIG. 5 is a partially sectional plan view of a chuck used in the first embodiment.

Hereinafter four examples embodying the present invention will be described according to the accompanying drawings.

FIGS. 1 to 7 show the first embodiment in which reference numeral 31 designates a main body stand for wire assembling. The main body stand 31 is constructed with angle brackets, beams, or the like 33 so as to have an extra length even if one wire cage 32 is disposed on the main body 31 as shown in FIGS. 3 and 4, and two main body stand 31 of the same shape are placed in parallel with each other. 34 designates channel rails the inner sides of which are open. The rails 34 are fixed at both shoulder parts of the main body stand 31 in full length. 35 designates a channel guide the upper side of which is open. The guide 35 is fixed at the center of each upper beam 31*a* of the main body stand 31 in full length. The guide 35 is used for guiding a steel tape 59 and a chuck 40 described later and is also used for supporting the wire cage 32.

36 designates an end metal receiving base provided at the front end of the body stand 31. 38 designates a carriage on which an end metal is placed. The plan shape of the carriage 38 is a quadrilateral and the section thereof has a V-shape as shown in FIG. 3, so that the end metal (or shoe) 37 for a concrete pole or pile can be easily disposed on the carriage 38. The carriage 38 has wheels 39 and the wheels 39 are disposed interiorly of the channel rails 34, so that the carriage 38 can move freely forward and backward on the main body stand 31.

In FIGS. 5 to 7, 40 designates a chuck and 41 designates a cylindrical case which is an outer part of the chuck 40. At the front part of the case 41 a taper part 42 is formed in which a front end periphery is inclined toward the center of the case 41, so that the chuck 40 can smoothly move forward inside the wire cage 32. 43 and 44 designate rings fixed at the front lower part of the chuck 40. A traction rope of a steel tape, wire or the like is connected with the ring 43 in order to draw the chuck 40 into the cage 32.

The chuck 40 can pull a required number of tension wires 45 at the same time by clamping them thereto. Namely a front wall 46 and a rear wall 47 are respectively fixed at the inner front and rear parts of the chuck case 41 a certain interval being maintained between them by welding, or otherwise securing, the same to the case 41. A screw shaft 48 is provided in a freely rotatable manner at the inner central part of the case 41 penetrating through the front and rear walls 46 and 47. The front end of the screw shaft 48 has a polygonal section so that the shaft 48 can be easily rotated by a spanner or by hand, and further at the front part of the screw shaft 48 a handle having knurls is welded thereon.

The screw part 48*a* of the screw shaft 48 is interposed between the front wall 46 and the rear wall 47. A circular plate 50 is disposed on the screw part 48*a* so as to move forward and backward by the rotation of the screw shaft 48. 51 designates a guide bar for preventing the circular plate 50 from turning. The guide bar 51 is provided between the front and rear walls 46 and 47 penetrating through a part of the plate 50. 52 designates a nut for securing the rear end of the screw shaft 48. The nut 52 is locked by a split pin or the like 53 so as to always rotate together with the screw shaft 48 as one body.

The front wall 46 has a conical inner surface which is widened toward the rear side and the rear end inner periphery of the wall 46 has a projected wedge 46*a*. According to the forward movement of the said circular plate 50 the ends of the tension wires 45 are held between the outer periphery of the plate 50 and the projected wedge 46*a* to be fixed there. The rear wall 47 has holes 47*h* corresponding to the number of the wires 45. A projected part 47*a* is formed at the rear central part of the rear wall 47, so that a doughnut-shaped groove is made between the projected part 47*a* and the rear end inner surface of the case 41. Inside the groove there is disposed a ring-shaped guide plate 54 having notches 54*a* corresponding to the holes 47*h*.

A spring groove 54*b* crossing each notch 54*a* is provided throughout the full length of the outer periphery of the guide plate 54. Inside the groove 54*b* there is disposed a spring 55 of a C-ring shape with both ends bent outward and formed into an L-shape. The spring 55 contacts the wires from the outside which are inserted through the holes 47*h* and the notches so as to press and fix them. The spring 55 can correspond to the change of the wire diameter within a certain range by changing the inner diameter of the spring according to the thickness of the tension wire 45 as shown by a solid line and a dotted line in FIG. 7.

56 designates a washer for fixing the guide plate 54 to the rear wall 47 by contacting the same with the inner periphery of the guide plate 54. By the elasticity of the washer 56 the guide plate 54 can be freely attached and removed. 41*a* designates a notch of a case 41 into which the bent ends of the spring 55 are disposed and where the inner diameter of the spring 55 is adjusted. 41*b* designates a window provided on the periphery of the case 41.

57 designates a base on which the chuck 40 is disposed. The base 57 is disposed on the main body stand 31 at a suitable position where the wire cage 32 is not placed and has a width sufficient enough to be disposed on the rails 34. The central part of the base 57 has a V-shape similar to the carriage 38 so that the chuck 40 can be easily disposed on the base. 58 designates equipment for drawing a steel tape 59 which is provided in front of the main body stand 31 an upsetter 60 being interposed between the main body 31 and the equipment 58. The equipment 58 moves freely to the right and left on rails 61 laid laterally in front of the two main bodies 31 parallel to each other. The equipment 58 feeds the steel tape 59 forward by rollers 62 of rubber or the like which are rotated at low speed by a prime mover (not shown in the drawing) and which can move up and down whereby the steel tape is wound by the drum 69.

The upsetter 60 can move freely to the right and left, on rails 63 laid in front of the two main body stands 31 which length is the same as that of the rail 61, through a carriage 64 and can also move forward and backward on the carriage 64. 65 designates a hook provided at the forward end of the steel tape 59. 66 designates a stopper for the carriage 38. The stopper 66 is attached to the rail 34 so that the carriage 38 is stopped near the end of the wire cage 32 disposed on the main body 31. 67 designates a guide for the steel tape 59 placed between the end metal 37 and the drawing equipment 58, 68 designates end cages, and 69 designates the take-up drum of the drawing equipment 58.

Hereinafter the operation of the first embodiment of the present invention will be explained.

First preparation for working a power source or the like for the drawing equipment 58 and the upsetter 60, the vertical movement of the rollers 62, and the conveying and the stopped position of the steel tape 59 are confirmed. On the other hand the stopping position of the carriage 38 is determined by attaching the stopper 66 at a predetermined position of the rail 34 according to the size of the product. Subsequently the wire cage 32 having end cages 68 at both ends is disposed at a predetermined position of the guide 35 placed on the main body stand 31, the drawing equipment 58 is placed in front of the main body 31, and the guide 67 is provided between the end metal receiving base 36 and the drawing equipment 58.

Figure 6:
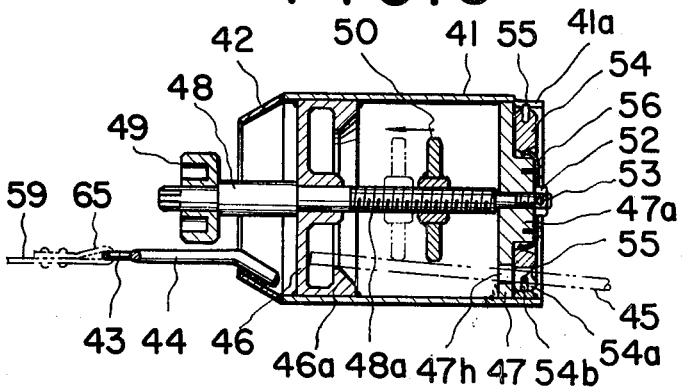
FIG. 6 is a central sectional elevation view of the chuck of FIG. 5.
Figure 7:
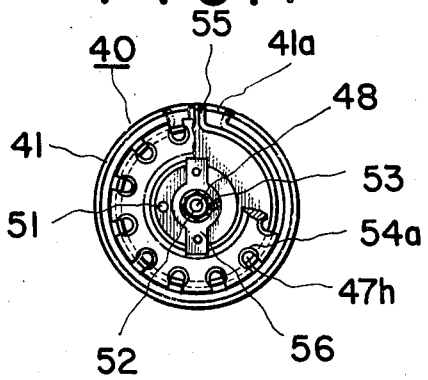
FIG. 7 is a rear elevation view of the chuck of FIG. 5.
Figure 8A:
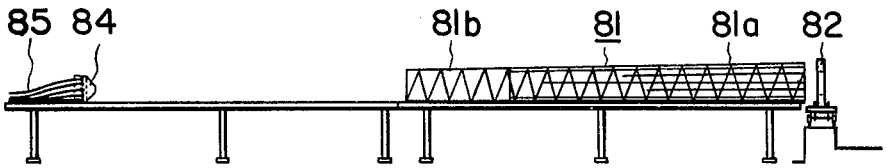
FIGS. 8(A), (B), (C) and (D) are partial side elevation views showing how tension wires are inserted through a wire cage in the second embodiment of the present invention.
Figure 8B:
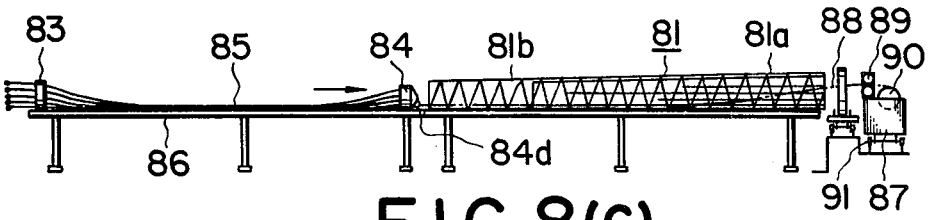
Figure 8C:
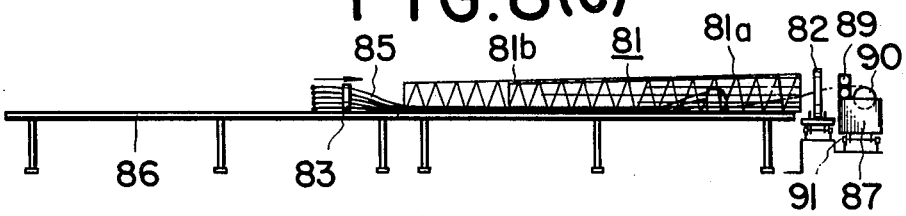
Figure 8D:
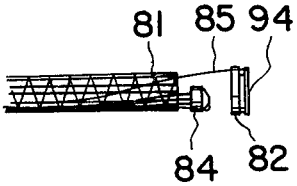

Next the drawing equipment 58 is operated (i.e. the rollers 62 are rotated) to send the steel tape 59 from the guide 67 into the wire cage 32. The bases 57 on which the chuck 40 is placed is disposed on the rails 34 on the rear side of the wire cage 32, and the hook 65 at the forward end of the steel tape 59 is engaged with the ring 43 provided at the front end of the chuck 40 as shown in FIGS. 5 and 6. About that time a required number of tension wires 45 are inserted through the end metal 37 and the forward ends of the same are inserted into the chuck 40 so as to be clamped.

In order to clamp the forward ends of the tension wires 45 by the chuck 40, first the guide plate 54 is disposed inside the rear end of the chuck case 41. Subsequently the positions of the holes 47*h* of the rear wall 47 and the notches 54*a* of the guide plate 54 are adjusted so as to align them together, and the C-shaped spring 55 is widened at the notch 41*a* of the case 41. (Refer to FIG. 7.) The tension wires 45 are inserted through the holes 47*h* and the notches 54*a* radially interiorly of the spring 55. The forward ends of the wires 45 are contacted with the projected inner periphery of the front wall 46, the circular plate 50 is moved forward by the rotation of the screw shaft 48, and the forward ends of the wires 45 are held and clamped between the outer periphery of the circular plate 50 and the projected inner periphery of the front wall 46 and the outer periphery of the holes 47*h* of the rear wall 47.

After the tension wires 45 are clamped, the base 57 is removed and the chuck 40 is disposed on the guide 35. Subsequently the tape guide 67 is removed and the rollers 62 and the drum 69 of the drawing equipment 58 are rotated so as to draw the tape 59. Thus the required number of tension wires 45 can be surely inserted into the wire cage 32 at one time by the chuck 40.

In the above inserting operation, since the chuck 40 has the tapered part 42, it can move relatively smoothly inside the cage 32. At this time the carriage 38 on which the end metal 37 is disposed also moves together with the chuck 40, but when the inserting operation of the wires 45 is finished, the carriage 38 is stopped near the opening part of the end cage 68. The inserting operation is finished when the chuck 40 is placed outside the open part of the front end cage 68. A time switch, a limit switch or the like can be used to finish the operation. After finishing the above operation, the steel tape 59 is disengaged from the chuck 40 and the tension wires 45 are released from the clamped state.

The released wires 45 are respectively removed from the chuck 40 and each forward end of the wires 45, inserted through the end metal 37 on the base 36, is placed in front of the wire cage 32. The drawing equipment 58 is moved to the front part of the other main body stand 31 and the forward ends of the tension wires 45 are upset by the upsetter 60. The wires 45 having rivet heads made by the upsetting work are fixed inside the wire cage 32 and the wire assembling is finished. On the other main body stand 31 the operation for inserting tension wires into the next cage is performed. During this inserting operation a new wire cage 32 is disposed on the former main body stand 31. Thereafter the same operation is repeated.

Hereinafter the second embodiment of the present invention will be described according to FIGS. 8 to 11.

In the above first embodiment, after the tension wires are inserted through the wire cage, the forward ends of the wires are upset. In the second embodiment both ends of tension wires are previously upset and a number of tension wires having rivet heads are inserted into one wire cage at a time. The object of the present embodiment is to improve the working efficiency as compared with the method in the first embodiment.

FIGS. 8 (A) to (D) are side elevation views showing how tension wires are inserted through a wire cage for a concrete pole. (In practice a wire cage is disposed inside a mold). The operation will be described hereinafter in the detail in order of the process.

First an anchor plate 82 is placed near the largest diameter part of a wire cage 81 composed of a non-tension wire cage 81*a* and an end cage 81*b*. A required number of tension wires 85 the forward ends of which are upset are inserted through a tension plate 83, and thereafter the rear ends of the wires 85 are upset and fixed to a chuck 84. They are placed on the smallest diameter side of the cage 81. (Refer to FIG. 8 (A).) The tension plate 83 is formed into a doughnut shape and has holes corresponding to the number of the tension wires 85 so that each wire 85 passes through each hole.

Figure 9:
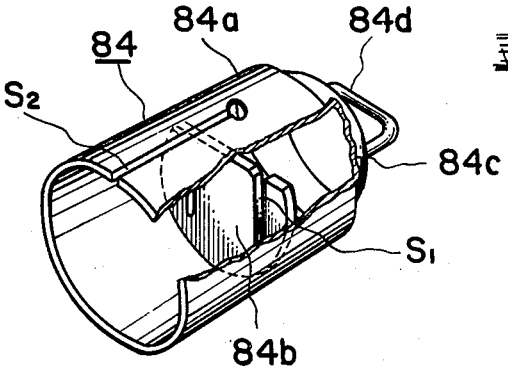
FIG. 9 is a partially cut perspective view of a chuck used in the second embodiment.

For the chuck 84, as shown in FIG. 9, a semicircular plate 84*b* is fixed inside a cylindrical main body 84*a*, a tapered part 84*c* is formed on the forward end outer periphery so that the chuck 84 slides easily inside the cage 81, and a metal fitting 84*d* for engaging with a traction rope is attached to the front end surface. The semicircular plate 84*b* has vertical slits S1, and another slit S2 is provided within the upper part of the main body 84*a*. The tension wires 85 having rivet heads 85*a* pass through the slit S2 and are inserted into the slits S1 from the upper side thereof in order that the rivet heads 85*a* are placed on the front side of the plate 84*b*, and when the chuck 84 is pulled forward the rivet heads 85*a* are fixed therein.

The tension wires 85 are disposed on a sliding base 86 from the chuck side. A traction rope 88 of a steel tape or the like is sent from equipment 87 placed near the largest diameter part of the cage 81 into the cage 81, and the forward end of the rope 88 is engaged with the metal fitting 84*d* of the chuck 84, and thereafter the equipment 87 is operated to draw the tension wires 85 into the cage 81. (Refer to FIGS. 8 (B) and (C).) The sliding base 86 has a channel shape the upper side of which is open. The equipment 87 has two rollers 89 on the left end and a take-up drum 90 on the right side of the rollers. The rollers 89 are placed above and below the rope 88 and at least one of them rises and falls so as to widen the interval between them. The rollers 89 and the drum 90 are freely rotatable by a motor (not shown in the drawing). The equipment 87 has also wheels 91 at the lower part thereof so that it can freely move to the right and left on rails.

After the inserting operation is finished, the wires 85 are removed from the chuck 84 and are engaged with the anchor plate 82, in order, which is placed near the largest diameter part of the cage 81 as shown in FIG. 8 (D). The removal of the wires 85 from the chuck 84 is done by first removing the same from the slits S1 and next removing the same from the slit S2.

Figure 10:
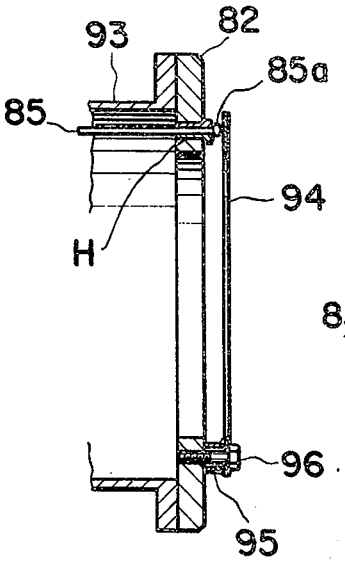
FIG. 10 is an enlarged sectional view of a mold end showing how wires are tensioned and fixed in the second embodiment.
Figure 11:
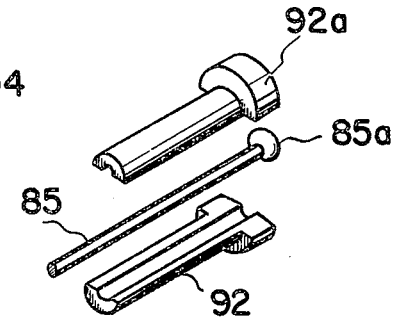
FIG. 11 is an enlarged perspective view showing the end of a tension wire and a split metal for tensioning and fixing the wire.
Figure 12:
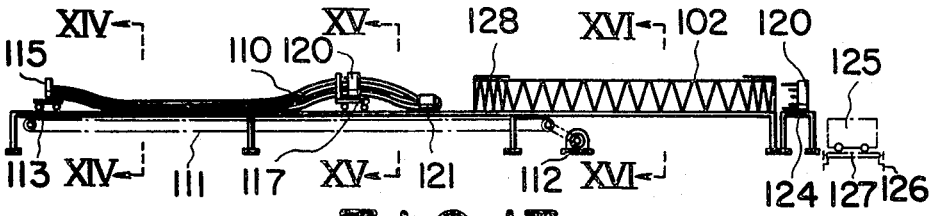
FIG. 12 is a partial side elevation view showing how tension wires are inserted into a wire cage in the third embodiment.

FIGS. 10 and 11 show how the wires 85 are engaged with the plate 82. FIG. 10 is a sectional view of the largest diameter part of the cage 81 at the time of tensioning the wires 85. Namely the anchor plate 82 has holes H corresponding to the number of the tension wires 85 through which the rivet heads 85*a* can pass, and inside each hole H a split bush 92 having a flange 92*a* is disposed.

The split bush 92 has a shape as shown in FIG. 11. After the bush 92 is disposed on the end of the wire 85, the wire 85 is inserted through the hole H of the anchor plate 82, so that the rivet head 85*a* is fixed to the flange 92*a* of the bush 92, the flange 92*a* is fixed to the end surface of the anchor plate 82, and the anchor plate 82 is fixed to the end surface of a mold 93. A cover plate 94 is attached to the outer surface of the anchor plate 82 through means of a collar 95 by a bolt 96 after the tension wires are fixed.

In the above state, the tension plate 83 is pulled in the opposite direction of the larger diameter side of the cage 81 so as to impart tension to the tension wire 85 and some holding device is interposed between the tension plate 83 and the smallest diameter end surface of the mold 93 so as to fix the tension plate 83, whereby the tension imparted to the tension wire 85 can be maintained.

Hereinafter the third embodiment of the present invention will be described according to FIGS. 12 to 18.

In the above-described first and second embodiments, a number of tension wires are drawn from one side of a wire cage to another side of the cage. In the present embodiment a number of tension wires are pushed into a wire cage from the rear side to the front side.

Figure 13:
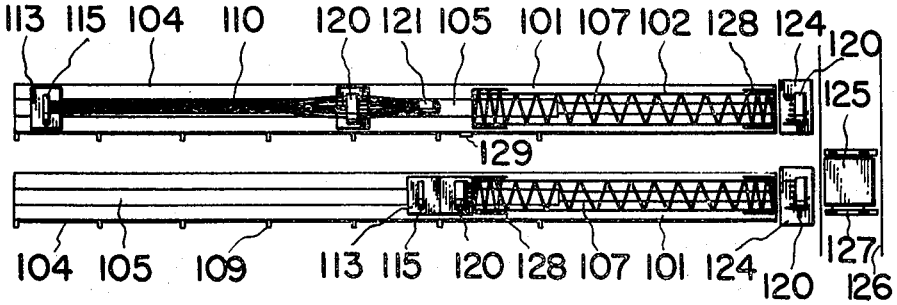
FIG. 13 is a plan view corresponding to FIG. 12.
Figure 14:
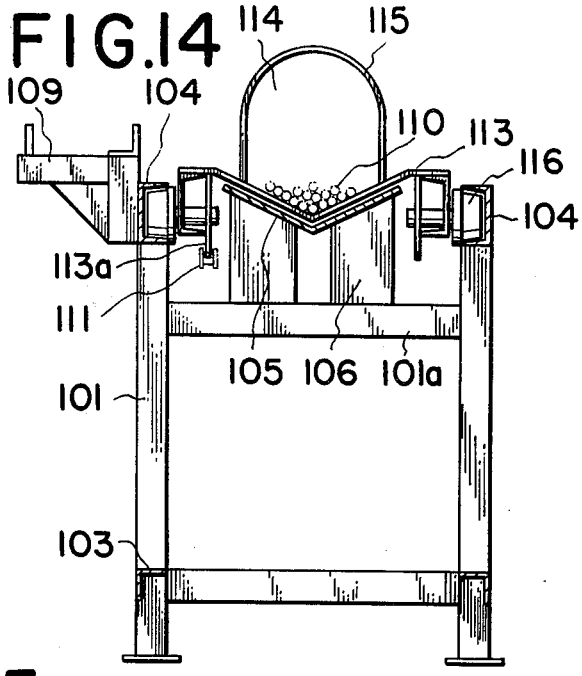
FIG. 14 is an enlarged sectional view taken along the line XIV — XIV of FIG. 12.
Figure 15:
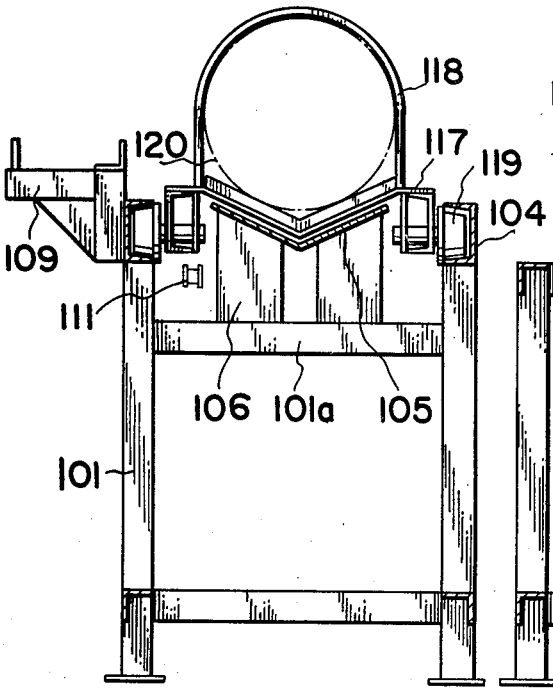
FIG. 15 is an enlarged sectional view taken along the line XV — XV of FIG. 12.
Figure 16:
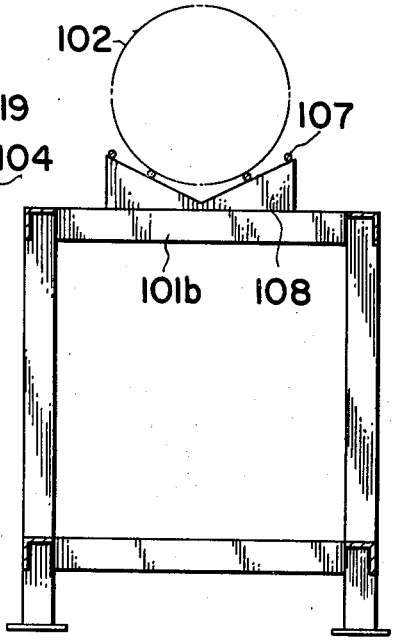
FIG. 16 is an enlarged sectional view taken along the line XVI — XVI of FIG. 12.
Figure 17:
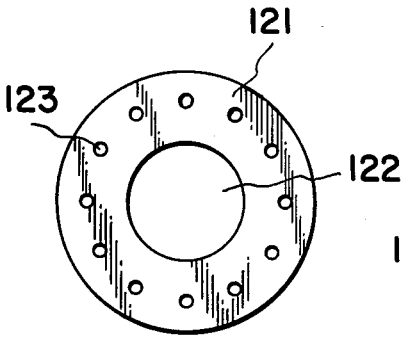
FIG. 17 is an enlarged rear elevation view of a chuck used in the third embodiment.
Figure 18:
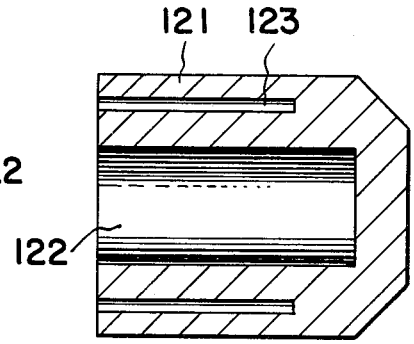
FIG. 18 is a central sectional elevation view of the chuck of FIG. 17.

In the drawings, reference numeral 101 designates a main body stand constructed by angle brackets, beams, or the like 103 so as to have a sufficient length when a wire cage 102 is disposed on the main body 101, and two main body stands of the same shape are placed in parallel with each other. 104 designates channel rails the inner sides of which are open, fixed at both shoulder parts of the main body stand 101 and running the full length of the stand 101. 105 designates a guide plate which section has a V-shape fixed at the center of each upper beam 101*a* of the main body stand 101 through supporting plates 106, and the guide plate 105 extends from the rear end to the front part of the main body 101 as shown in FIG. 13.

107 designates four round bars for supporting the wire cage 102. The bars 107 extend from the forward end of the guide plate 105 to the forward end of the main body 101, and two bars are fixed at each side on a supporting plate 108 of a V-block shape provided at the center of each upper beam 101*b* of the main body stand 101. The heights of the upper surfaces of the round bars 107 are the same as that of the guide plate 105. Therefore the wire cage 102 can be continuously supported by the guide plate 105 and the round bars 107. The guide plate 105 supports the wire cage 102 at its end part and at the place where the cage 102 is not disposed the guide plate 105 supports tension wires 110 and a chuck 121 described later to aid the slide thereof.

109 designates bases, on which the tension wires 110 are disposed, constructed of steel angles or the like. The bases 109 are attached to one side surface of the rail 104 at suitable intervals along the length thereof and extend as the full length of the guide plate 105. 129 designates a carriage stopper for determining the stopping position of an end metal receiving carriage 117 according to the size of the product and the stopper 129 is attached to the rail 104. 111 designates a wire or chain provided at the inner side of the main body 101 extending from the rear end to the front part of the main body 101. The wire or chain 111 is rotated slowly by a motor 112 provided at the front part of the main body 101.

113 designates a carriage for pushing the tension wires 110 which plan shape is a quadrilateral and which section has a V-shape. The carriage 113 is provided with a pushing plate 114 having a frame plate 115 on the front side. Moreover the carriage 113 has wheels 116 so as to be freely movable forward and backward on the rails 104. Further the carriage 113 has a member 113*a* engageable with the wire or chain 111.

The central part of the end metal receiving carriage 117 is formed into a V-shape similar to the carriage 113, so that an end metal 120 (or a shoe) can be easily disposed on the carriage. The upper rear part of the carriage 117 is provided with a guide 118 so that the tension wires 110 can be smoothly inserted through the end metal 120. The carriage 117 can move freely forward and backward on the main body 101 by wheels 119 similar to the carriage 113.

The forward ends of the tension wires 110 are disposed into the chuck 121. The chuck 121 is made of a light material, for example synthetic resin or the like. It is formed into a cylinder having a hollow part 122 and the outer periphery of the forward end of the chuck is beveled, so that the chuck 121 can move smoothly forward inside the wire cage 102. The peripheral wall of the chuck 121 has slots 123 of a predetermined depth extending from the rear end. The wires 110 are respectively disposed into each slot 123, and accordingly the diameter and the number of the slots 123 correspond to those of the wires 110. 124 designates an end metal receiving base placed in front of the main body 101.

125 designates an upsetter which is freely movable to the right and left through means of a carriage 127 on rails 126 laid laterally in front of the two main bodies 101 parallel to each other. The upsetter 125 can also move forward and backward on the carriage 127. 128 designates end cages incorporated with the wire cage 102.

The inserting operation in the present embodiment will be described hereinafter.

First an electrical system for operating the upsetter 125, the motor 112 and the like is established. Thereafter the stopper 129 is attached to the rail 104 in order to determined the stopping position of the end metal receiving carriage 117 according to the size of the product. Subsequently the front part of the wire cage 102 having the end cages 128 incorporated at both ends is disposed on the round bars 107 and the rear part of the cage 102 is disposed on the guide plate 105, and thereafter the cage 102 is set at the appointed position.

Next the carriage 113 is moved to the rear part of the main body 101, the end metal receiving carriage 117 is moved to the central part, and the end metal 120 is disposed on the carriage 117. Thereafter the chuck 121 is disposed on the guide plate 105 in front of the carriage 117, and a required number of tension wires 110 previously prepared on the bases 109 are inserted through the end metal 120 one at a time. Further the forward ends of the wires 110 are respectively disposed into each slot 123 of the chuck 121, the rear parts of the wires 110 are disposed on the guide plate 105 in order so as not to cross each other, and the rear ends of them are disposed on the carriage 113.

Next the chain 111 is rotated by the motor 112 so as to move the carriage 113 forward and thereby push the wires 110 from the rear side. At this time the chuck 121 moves forward together with the carriage 117 and it is led into the wire cage 102, and further it continues to move forward. During this process the carriage 117 is stopped by the stopper 129, but the chuck 121 and the wires 110 move forward and they are inserted through the wire cage 102, and thereafter the chuck 121 stops near the front end of the end cage 128. During the above inserting operation another end metal 120 is disposed on the base 124.

After the inserting operation is finished, each wire 110 is pulled out from the chuck 121 and inserted through holes of the end metal 120. Thereafter the forward ends of the wires 110 are upset by the upsetter 125 so as to have rivet heads thereon. After they are upset, the tension wires 110 are fixed inside the wire cage 102, and that means the wire assembling operation is finished. The upsetter 125 is moved to the front of another main body 101 for the next assembling operation. Thus while the assembling operation is performed on one main body, the preparation for the next assembling operation is performed on another main body, and thereby the assembling operation is continuously performed.

Hereinafter the fourth embodiment of the present invention will be described according to FIGS. 19 to 23. Similar to the third embodiment, in the present embodiment tension wires are inserted into a wire cage by pushing them from the rear side thereof. However differently from the third embodiment, end metal which becomes a part of the product is used as a main part of the pushing equipment, and the tension wires are inserted through holes of the end metal and are pushed under the condition that only one end thereof is fixed.

Figure 19:
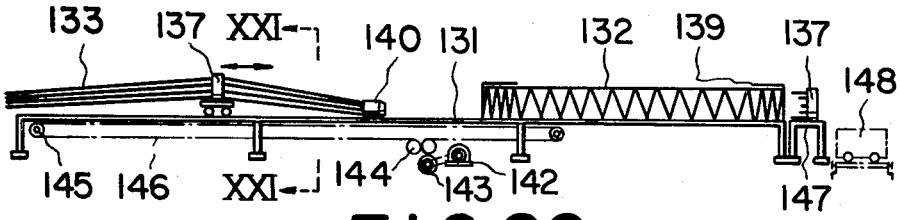
FIG. 19 is a partial side elevation view showing how tension wires are inserted into a wire cage in the fourth embodiment of the present invention.
Figure 20:
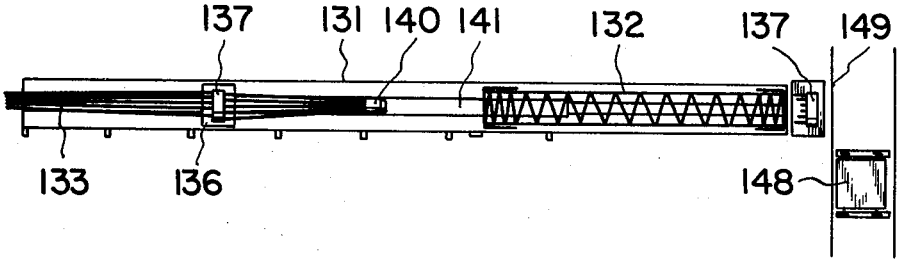
FIG. 20 is a plan view corresponding to FIG. 19.
Figure 21:
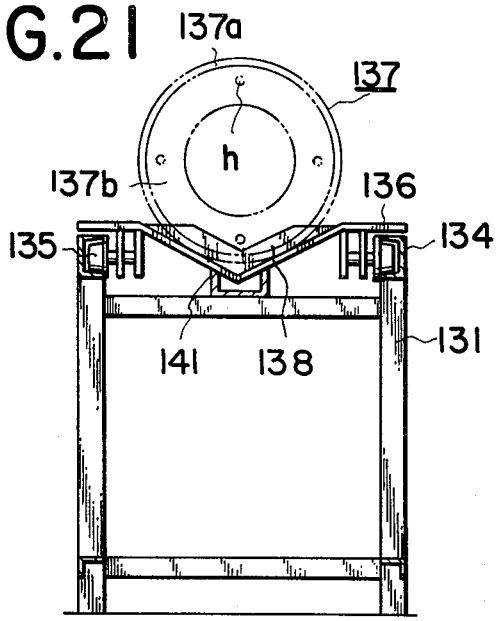
FIG. 21 is an enlarged sectional view taken along the line XXI — XXI of FIG. 19.

FIGS. 19 and 20 are respectively a side elevation view and a plan view. A wire cage 132 is disposed on a front part of a main body stand 131 of a long bed shape made of a steel frame, and tension wires 133 are pushed from the rear side thereof.

Figure 22A:
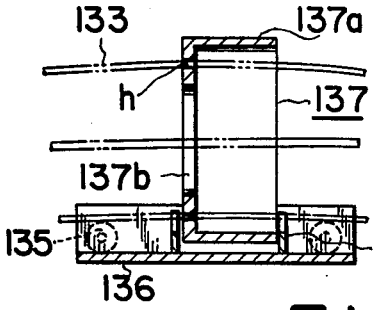
FIGS. 22(A) and (B) are enlarged sectional views showing how tension wires are sent by an end metal for a concrete pole or pile in the fourth embodiment.
Figure 22B:
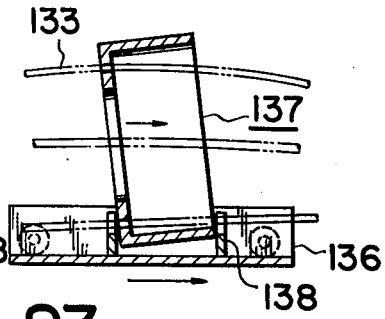

Channel rails 134 the inner sides of which are open are provided at both shoulder parts of the main body stand 131. A carriage 136 having wheels 135 disposed inside the rails 134 is provided on the main body 131. The central part of the carriage 136 has a V-shape. An end metal 137 composed of a reinforcing band 137*a* and a seat plate 137*b* which are made as one body is disposed at the center of the V-shaped surface. A pair of brackets 138 are provided on the V-shaped surface of the carriage 136 at an interval equal to the width of the end metal 137, and the position where the end metal 137 is disposed is determined by the brackets 138. The end metal 137 can be inclined backward through a predetermined angle as shown in FIG. 22 (B).

The seat plate 137*b* of the end metal 137 has a suitable number of holes *h* through which the wires 133 are inserted. The forward ends of the wires 133 inserted through the holes *h* are clamped by a chuck 140 similar to that used in the first embodiment. The chuck 140 is disposed on a guide rail 141 laid at the upper central part of the main body 131 and moves forward according to the movement of the wires 133. The outer periphery of the front end of the chuck 140 is beveled or is formed into a streamline shape and it is made of a light material, so that the chuck 140 can move without hindrance even inside the wire cage 132.

142 designates a motor provided at the lower part of the main body 131. The motor 142 drives a wire, chain, belt or the like 146 through means of a rotating drum 143, a guide wheel 144 and a take-up wheel 145 which is supported horizontally at the upper part of the main body 131. The belt 146 is engaged with the carriage 136 so as to move the carriage 136 forward and backward through a predetermined stroke.

Figure 23:
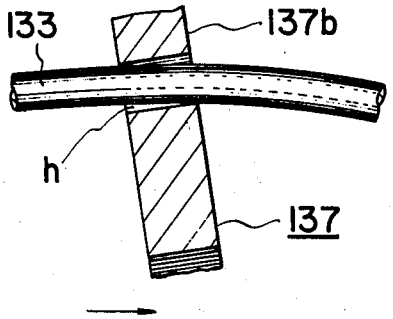
FIG. 23 is an enlarged sectional view showing how the tension wire is fixed to the end metal.

According to the reciprocating movement of the carriage 136, the end metal 137 is moved forward and backward as a result of contacting the brackets 138. When the carriage 136 moves forward, the end metal 137 is inclined backward as a result of receiving frictional resistance due to the contact with the wires 133 as shown in FIG. 22 (B), and simultaneously as shown in FIG. 23, the wires 133 receive frictional resistance from the upper rear end and the lower front end of each hole *h* through which each wire 133 in inserted, and thereby the tension wires 133 are sent forward together with the end metal 137.

When the carriage 136 moves backward, the end metal 137 is also moved backward. The cylindrical reinforcing band 137*a* is in contact with the V-shaped surface of the carriage 136 as a result of the width of the band 137*a*. In this state the seat plate 137*b* receives a forward pushing force as a result of the contact with the tension wires 133. In fact since the metal 137 is moved backward, the forward pushing force is resisted due to the rest of the wires 133. That means the top of metal 137 is pushed to the right, and thereby the end metal 137 is standing erectly to a certain extent. Therefore the tension wires 133 are resting while the end metal 137 is moved backward regardless of the fact that the wires 133 are inserted through the holes h of the end metal 137, and the wires 133 are inserted into the wire cage 132 intermittently in accordance with the reciprocating movement of the carriage 136.

A base 147 on which another end metal 137 is disposed is placed in front of the main body 131. An upsetter 148 is placed in front of the base 147. The upsetter 148 upsets the forward ends of the tension wires 133 after they are inserted through the wire cage 132 and the end metal 137 placed on the base 147. (Note: The rear ends of the wires 133 are previously upset so as to have rivet heads.) The upsetter 148 can move freely to the right and left upon rails 149 so that in case some main bodies are placed in parallel with each other, it can be placed in front of any one of them.

Hereinafter the inserting method of the present embodiment will be described concretely. First the wire cage 132 having end cages 139 outside both ends is placed on the main body stand 131, and the end metals 137 are respectively placed on the carriage 136 and the base 147 facing each other. On the base 147 a shoe is disposed instead of the end metal 137 according to circumstances.

Next the tension wires 133, the rear ends of which are upset, are inserted through the holes *h* of the end metal 137 and the forward ends of them are clamped by the chuck 140 similar to the case in the first embodiment. Subsequently the motor 142 is operated so as to reciprocate the carriage 136 by the belt 146 through the drum 143 and the wheels 144 and 145 so that the wires 133 are inserted gradually into the wire cage 132. The wires 133 are not necessarily inserted intermittently. For example they can be continuously inserted by continuously moving the carriage 136 for some distance.

Thereafter the forward ends of the tension wires 133 are disengaged from the chuck 140 and inserted through the end plate 137, and further they are upset by the upsetter 148 so as to have rivet heads. Next the end metal 137 on the carriage 136 is moved forward, the end cages 139 disposed outside the wire cage 132 are moved to both ends of the cage 132, and both end metals 137 are fixed to both end cages 139. The inserting operation is then finished.

The four embodiments of the present invention have been described hereinbefore. The order of the arrangement and the removal of each member and equipment in each embodiment can be changed optionally within the range so as not to disturb the enforcement of the present invention according to some concrete cases.

Each embodiment is applicable to the wire arrangement for any concrete pole and concrete pile. Further the present invention can be enforced in both cases wherein the rivets heads are formed only at one end of the tension wires or made at both ends of the wires.

I claim:

1. A method of inserting tension wires within a wire cage for facilitating the process of wire assembling for a concrete pole, pile, or the like, comprising the steps of:

placing a wire-clamping chuck upon a channel guide provided upon the upper surface of a main body stand;

drawing a tractive member out from drawing equipment and passing the same through said wire cage so as to be connected to the front end of said chuck;

inserting said tension wires through a carriage so as to be movably supported thereby and disposing the front ends of said wires within said chuck;

interposing said front ends of said wires between a fixed, annular, tapered wall of said chuck and a threadedly rotatable, linearly movable plate member;

rotating said plate member so as to linearly move the same toward said fixed, annular wall member of said chuck so as to fixedly grip said front ends of said wires therebetween;

actuating said drawing equipment so as retract said tractive member and draw said chuck and said wires through said cage;

removing said wires from said chuck;

upsetting the forward ends of said wires so as to form rivets thereon; and fixing said rivet ends of said wires within said cage.

2. A method of inserting tension wires within a wire cage for facilitating the process of wire assembling for a concrete pole, pile, or the like, comprising the steps of:

placing a wire cage upon a channel guide provided upon the upper surface of a main body stand;

pre-forming rivet heads upon the forward ends of said tension wires;

inserting said tension wires within a tension plate and upsetting the rear ends of said tension wires so as to form rivet heads upon said rear ends of said wires for engaging said tension plate;

inserting the forward ends of said wires through an axially extending slit provided within the periphery of a chuck also disposed upon said channel guide;

engaging said rivet heads formed upon said forward ends of said wires within radially extending slits provided within a radially disposed plate within said chuck so as to fix said wires within said chuck;

connecting a tractive member, drawn out from drawing equipment and passed through said cage, to the front end of said chuck;

retracting said tractive member so as to draw said chuck and said wires through said cage;

removing said wires from said chuck; and fixedly securing said wires within an anchor plate so as to facilitate a tensioning operation.

3. A method of inserting tension wires within a wire cage for facilitating the process of wire assembling for a concrete pole, pile, or the like, comprising the steps of:

placing a wire cage upon longitudinally extending bars supported upon a guide plate provided upon the upper surface of a main body stand;

inserting said tension wires within and through a carriage slidably supported upon said main body stand;

disposing the forward ends of said tension wires into axially extending slots of a chuck slidably supported upon said main body stand;

operatively connecting the rear ends of said wires with a thrusting carriage slidably supported upon said main body stand;

moving said thrusting carriage forwardly along said main body stand so as to push said chuck and said wires through said wire cage;

removing said wires from said chuck; and upsetting the forward ends of said wires so as to form rivet heads thereon.

4. A method of inserting tension wires within a wire cage for facilitating the process of wire assembling for a concrete pole, pile, or the like, comprising the steps of:

placing a wire cage upon a channel guide provided upon the upper surface of a main body stand;

inserting the rear ends of said tension wires within a tiltable member of a thrusting carriage reciprocably disposed upon said main body stand;

inserting the forward ends of said wires within a chuck slidably disposed upon said main body stand;

driving said thrusting carriage in a reciprocal fashion along said main body stand so as to alternately cause said tilting member thereof to intermittently grasp and release said tension wires, depending upon the inclination thereof, so as to intermittently move said wires forwardly through said wire cage;

removing said wires from said chuck; and upsetting the forward ends of said wires so as to form rivet heads thereon.

* * * * *